US008171601B1

(12) United States Patent
Yurkon

(10) Patent No.: US 8,171,601 B1
(45) Date of Patent: May 8, 2012

(54) FIBER TUMBLER WITH CHANGEABLE SCREEN GRID SIZE

(76) Inventor: George Theodore Yurkon, Chardon, OH (US)

( * ) Notice: Subject to any disclaimer, the term of this patent is extended or adjusted under 35 U.S.C. 154(b) by 0 days.

(21) Appl. No.: 12/947,111

(22) Filed: Nov. 16, 2010

(51) Int. Cl.
*D01B 3/00* (2006.01)

(52) U.S. Cl. ..... 19/200

(58) Field of Classification Search ..... 19/200; D15/147
See application file for complete search history.

(56) References Cited

U.S. PATENT DOCUMENTS

| | | | | | |
|---|---|---|---|---|---|
| 179,229 | A * | 6/1876 | Smith et al. | 209/288 |
| 3,113,733 | A * | 12/1963 | Carlson | 241/68 |
| 4,338,705 | A * | 7/1982 | Jones | 19/80 R |
| 4,450,758 | A * | 5/1984 | Belinkoff et al. | 99/332 |
| 4,487,323 | A * | 12/1984 | Marrs | 209/546 |
| 4,682,613 | A * | 7/1987 | DeLoach | 134/58 R |
| 5,346,071 | A * | 9/1994 | Page et al. | 209/257 |
| 5,512,733 | A * | 4/1996 | Takikawa et al. | 219/620 |
| 6,389,646 | B1 | 5/2002 | Pettigrew et al. | |
| 6,584,650 | B1 | 7/2003 | Pettigrew et al. | |
| D591,780 | S * | 5/2009 | Pfaff | D15/147 |
| 2005/0125910 | A1 * | 6/2005 | Guinibert et al. | 8/158 |
| 2007/0220776 | A1 * | 9/2007 | Guinibert et al. | 34/603 |
| 2008/0257168 | A1 * | 10/2008 | Wolfe | 99/348 |

* cited by examiner

*Primary Examiner* — Shaun R Hurley

(57) ABSTRACT

A system and method for cleaning fiber utilizes interchangeable panels having different screen grid sizes. The panels are selectively installed on a fiber cage frame pivotally coupled to a tumbler frame for rotation of the fiber cage frame. A user selects a set of panels having a grid size suitable for a fiber to be tumbled. The selected panels are installed on the fiber cage frame and the fiber is inserted into a space within the fiber cage frame through an opening in the fiber cage frame made available by a not-yet-installed panel. The fiber cage frame is rotated after installing the final panel. The resultant tumbling thereby causes particles to fall from the tumbler cage frame. At least one installed panel is removed from the fiber cage frame, and the fiber is removed from the fiber cage frame through the resultant opening in the fiber cage frame.

16 Claims, 6 Drawing Sheets

FIBER TUMBLER WITH CHANGEABLE SCREEN GRID SIZE

BACKGROUND

The present invention relates to cleaning fiber, and more particularly to removing foreign matter from fiber in preparation for further processing of the fiber.

It is important that fiber be clean when submitted to a fiber mill for processing into a yarn or other fiber product. Any foreign matter entangled in the fiber in the initial stages of processing or spinning will likely result in defects in the end product and/or cause problems with the complicated fiber processing machinery, potentially damaging the machinery. For example, alpaca fiber may contain heavy tags (manure and sweat locks), seeds, thistles, burrs and other undesirable matter. Removal of these items is essential before processing the fiber. Often, this is accomplished by a tedious and laborious skirting process whereby the foreign matter is manually picked from the fiber. The manual cleaning of the fiber is, however, error prone wherein particles that are deeply entangled in the fiber or too small to be noticed are often overlooked, resulting in the aforementioned defects in the end product and/or problems with the processing machinery.

For the aforementioned reasons, animal fiber such as sheep wool, angora goat hair (mohair), rabbit hair (angora), llama, alpaca, dog hair, and other exotic animals are frequently cleaned in a rotating tumbler which allows the foreign matter to fall out of the fiber through a wire screen. The openings in the screen are sized so that the fiber remains in the tumbler while the foreign matter is allowed to escape through the screen. Sizing of the grid comprising the screen is, however, problematic. For example, Huacaya alpacas are fluffy, somewhat like teddy bears, and Suri alpacas have long shiny locks of very soft, slightly curly hair. Consequently, a 1 inch square grid size is an efficacious size for tumble cleaning the fiber of a Huacaya alpaca, or other fluffy fiber, because it allows larger pieces of foreign matter or undesirably small clumps of fiber (second cuts) to pass through while retaining the desirable fiber. However, the same 1 inch grid size will allow the shiny, and somewhat slippery locks of Suri fiber to pass through and escape with the foreign matter. Therefore, a smaller grid size such as, e.g., ½ inch is more suitable for tumble cleaning Suri fiber. However, current fiber tumblers make no provision for changing grid sizes to suit a particular type of fiber. Fiber tumblers are usually made of a large hexagonal, cylindrical, or other shape fixed structure having a wire grid permanently fastened to the structure. Consequently, changing grid sizes would be laborious and difficult, or would require at least a second tumbler, an expensive alternative.

There is thus a need for an improved method and apparatus facilitating efficacious cleaning of various types of fiber having different characteristics.

SUMMARY

An apparatus is provided for tumbling fiber which includes a tumbler frame and a fiber cage structure pivotally coupled to the tumbler frame for rotation of the fiber cage structure about an axis. One or more removable cage panels, having openings of a first size, are included, wherein the cage panels cover an exterior portion of the fiber cage structure when installed on the fiber cage structure. The removable cage panels include openings sized large enough to permit particles to exit the fiber cage structure while yet sized small enough to substantially retain the fiber within the fiber cage structure. The fiber tumbles within the fiber cage structure upon rotation of the fiber cage structure, whereby particles are removed from the fiber upon rotation of the fiber cage structure.

Also provided is a fiber tumbler for tumbling a plurality of fiber types. The fiber tumbler includes a tumbler frame and a fiber cage structure. The fiber cage structure includes a cage frame pivotally coupled to the tumbler frame for rotation of the fiber cage structure about a rotational axis. Also included are one or more removable cage panels having openings of a first size, wherein the cage panels cover an exterior portion of the cage frame when installed on the cage frame. The removable cage panels include openings sized large enough to permit particles to exit the fiber cage structure while yet sized small enough to substantially retain a first type of fiber within the fiber cage structure. Further included are removable cage panels having openings of a second size, wherein the second removable cage panels likewise cover the exterior portion of the cage frame when installed on the cage frame. The removable second cage panels include openings sized large enough to permit particles to exit the fiber cage structure while yet sized small enough to substantially retain a second type of fiber within the fiber cage structure. A user selects cage panels from the set of first cage panels and/or the set of second cage panels suitable for use on the cage frame when tumbling a selected fiber. The user inserts and removes the selected fiber into and from the fiber cage structure by removing at least one of the installed panels, and the user reinstalls any removed panel prior to rotating the fiber cage structure. The selected fiber tumbles within the fiber cage structure upon rotation of the fiber cage structure, whereby particles are caused to be removed from the selected fiber upon rotation of the fiber cage structure.

Further provided is a method of cleaning fiber in a fiber tumbler. The method includes selecting by a user, a set of panels having a grid size suitable for a fiber to be tumbled. The selected set of panels are installed on a fiber cage frame which is pivotally coupled to a tumbler frame for rotation of the fiber cage frame about a rotational axis. At least one panel is left not installed, and the fiber is inserted into a space within the fiber cage frame through the opening in the fiber cage frame made available by the not-installed panel. The not-installed panel is installed thereafter on the fiber cage frame, and the fiber cage frame is rotated. The fiber thereby tumbles within the fiber cage frame, causing particles to fall from the tumbler cage frame through the panel grid during rotation of the fiber cage frame. At least one installed panel is removed from the fiber cage frame, and the fiber is removed from the fiber cage frame through the opening in the fiber cage frame made available by removal of the installed panel.

DETAILED DESCRIPTION

Figure 1:
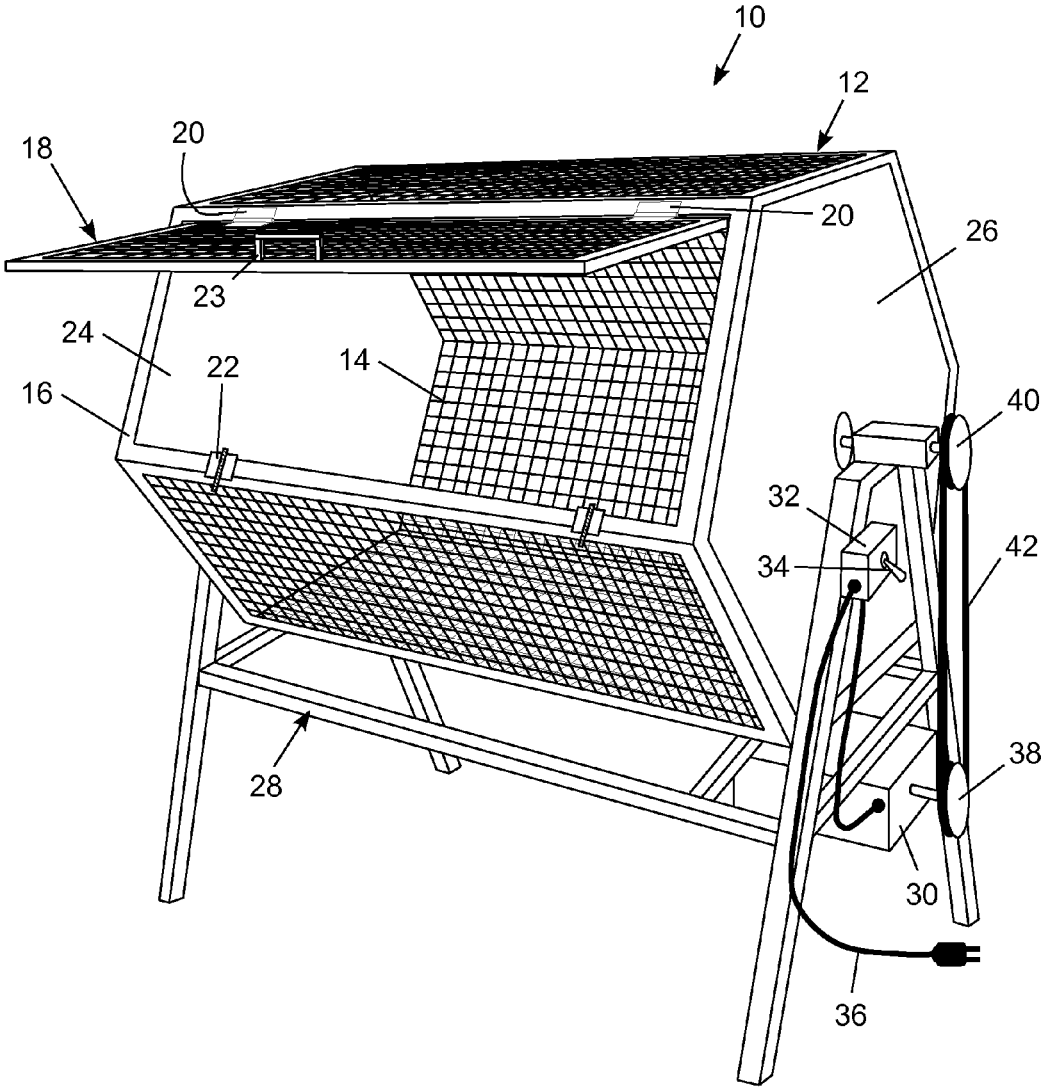
FIG. 1 (PRIOR ART)
FIG. 1 is a perspective view of an exemplary prior art fiber tumbler for cleaning fiber.

FIG. 1 is a perspective view of an exemplary prior art fiber tumbler 10 for cleaning fiber prior to processing the fiber for producing yarn or other fiber products. The particular prior art fiber tumbler 10 shown includes a rotating hexagon cage 12 although the rotating cage can be any configuration known in the art, e.g., cylindrical, spherical, etc. The cage 12 is substantially hollow and is partially or wholly covered by a screen grid 14 for permitting debris and other undesirable material to escape the rotating cage 12 while desirable fiber is retained within the cage 12. The cage 12, of course, includes a cage frame 16 of suitable design for supporting the grid 14. Of course, provision for access to the interior of the cage 12 is provided for inserting and removing the fiber. In the exemplary fiber tumbler 10, at least one hinged access panel 18 is provided. The access panel 18 is attached to the cage 12 via one or more hinges 20 and is secured in the closed position by one or more latches 22. A handle 23 is usually provided on the access panel to facilitate opening and closing the access panel. The cage 12 further includes end plates 24, 26 which are usually solid, however, the plates may alternately be partially or wholly comprised of a screen grid of sufficient strength to support the cage 12. It is to be appreciated that some cage configurations such as spherical do not require the use of end plates.

Provision must of course be made for supporting the rotating cage 12 and a cage support frame 28 of suitable design is therefore provided. In the exemplary embodiment shown, the support frame 28 also supports a drive motor 30, a drive control 32 which includes an on/off switch 34. A power cord 36 provides a means of connecting the drive control 32 to a power source (not shown). Provision for power transmission from the drive motor 30 to the cage 12 is provided by a drive pulley 38 mounted to a motor shaft of the drive motor 30, a driven pulley 40 mounted to the end plate 26 or a bearing shaft attached thereto, and a drive belt 42. Of course, it is to be appreciated that the drive assembly shown is for exemplary purposes only and that any form of drive mechanism including, e.g., a gear drive, a chain drive, or a manually operated crank mechanism, falls within the scope of the present application.

In operation, a user releases the latches 22, opens the hinged panel 18, and places the fiber inside the cage 12. The source of the fiber may include, e.g., an animal, organic material, synthetic material, and/or any other source. For example, the fiber may be selected from any of silk, dog hair, alpaca fleece, sheep wool, polyester, and/or any other material that is capable of being cleaned or otherwise benefits by tumbling. The hinged panel 18 is then closed and secured by the latches 22 after which the drive motor 30 is operated for a period of time sufficient to obtain the desired results. Access to the tumbled fiber is then gained by releasing the latches 22 and opening the hinged panel 18.

As previously described, a disadvantage of existing fiber tumblers such as the embodiment just described is that the screen grid 14 is permanently affixed to the tumbler cage 12. While one grid size may work well with one type of fiber such as, e.g., Huacaya alpaca fiber, other fibers such as, e.g., Suri alpaca fiber benefit from a smaller grid size. While one might envision changing the screen grid 14, it is readily apparent that such a process would be time consuming and laborious. Changing the grid 14 would require removing and reinstalling many attachment elements such as, e.g., screws and/or snaps, and unwrapping and handling a cumbersome grid, a tiresome and difficult process.

Figure 2:
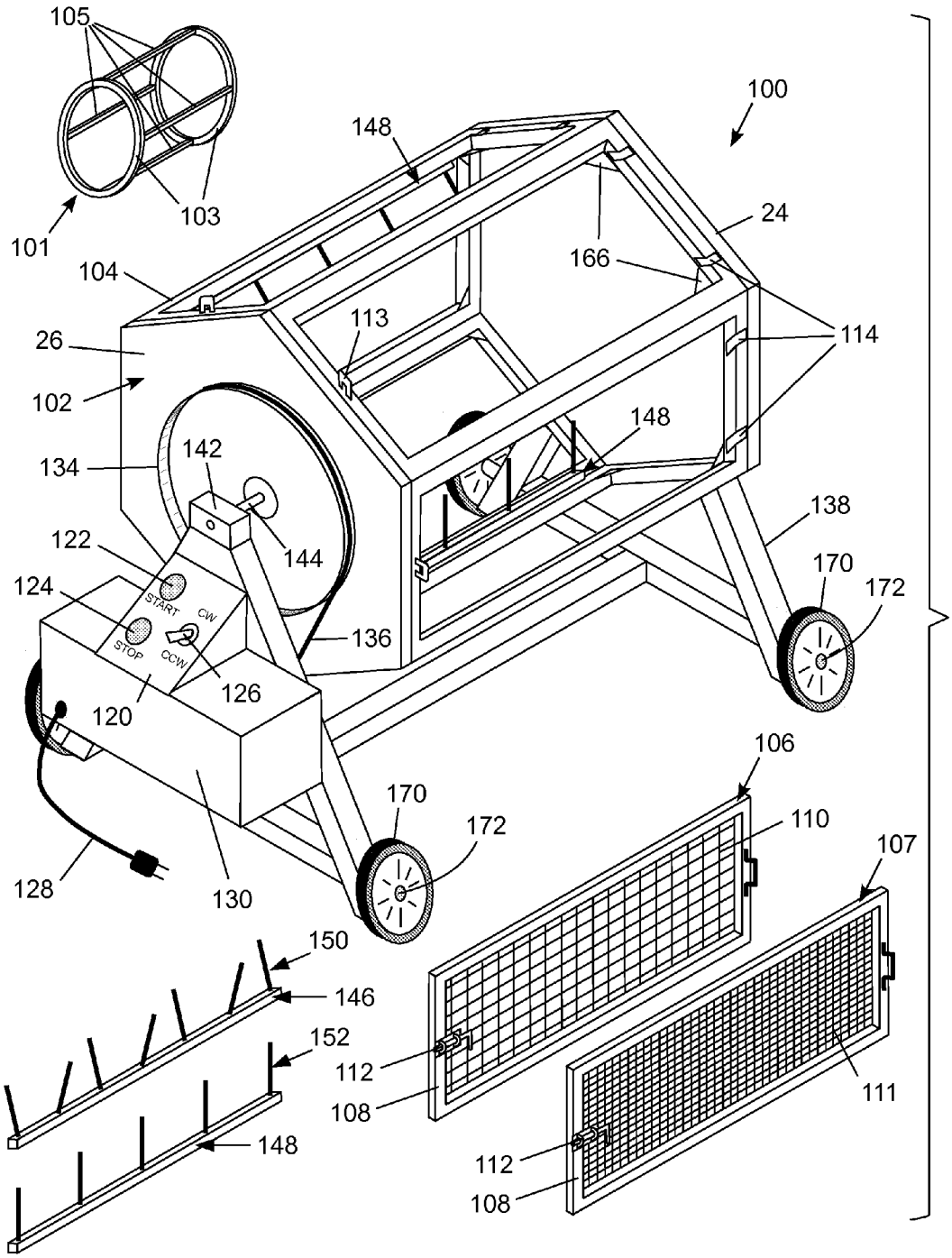
FIG. 2 is a fiber tumbler according to concepts of the present application shown in perspective view.

With reference now to FIG. 2, and continuing reference to FIG. 1 where like numerals represent like elements, a fiber tumbler 100 according to concepts of the present application is shown in perspective view, where like numerals indicate like elements. The embodiment shown includes a rotating hexagon cage structure 102 although, as previously described, the rotating cage structure can be any configuration known in the art, e.g., cylindrical, spherical, etc. The cage structure 102 includes end plates 24, 26 which, in preferred embodiments are solid, however, the plates may alternately be partially or wholly comprised of a screen grid of sufficient strength to support the cage structure 102. Again, it is to be appreciated that the cage configuration shown is an exemplary shape, and some cage configurations such as spherical do not require the use of end plates. The cage structure 102 is substantially hollow and includes a cage frame 104 of suitable design for supporting elements comprising the cage structure 102 and other elements attached to the cage structure 102 as described hereinafter. Further, it is not necessary for the end plates 24,26 to be constructed in the same shape as a cross section of the cage frame 104. For example, in the case of a hexagonal cylinder as shown, it may be desirable to utilize circular end plates 24,26 to enhance the safety of the fiber tumbler 100. A user or other person is thus less likely to be struck by a sharp corner of the cage frame 104. While the cage frame 104 is shown in the drawing as a hexagonal configuration, it is to be understood that other configurations such as octagonal or square fall within the scope of the present application. Further, a cage frame comprising a round cylinder 101 (shown in a smaller scale for clarity) may be utilized in place of the octagonal, hexagonal or square cage frame 104. The round cylinder 101 includes a pair of circular end frames 103 and at least two cage frame members 105 connected to the pair of circular end frames 103 for maintaining a fixed alignment of the circular end frames 103 with respect to each other.

The fiber tumbler 100 includes a set of removable panels 106. While only one removable panel is shown in FIG. 2 for reasons of clarity, the number of panels in the set of removable panels preferably corresponds to the number of openings in the cage frame 104 except for any openings permanently covered by a screen grid. Each removable panel 106 comprises a panel frame 108 and a panel screen grid 110. In preferred embodiments, the removable panel 106 is secured to the cage frame 104 by means of retaining tabs 114 and a retaining latch 112 engaged with a catch 113. Of course, any suitable means of securing the removable panel 106 in place fall within the scope of the present application. For example, the removable panel may be a rigid or flexible grid that slides into slots on the cage structure 102. Each of the removable panels 106 is fitted with a panel screen grid 114. An advantageous feature of the embodiment shown is arises from the ability to interchange panels of various grid sizes. For example, if a silky fiber such as Suri alpaca fiber is being tumbled, the user can first select a set of panels 106 having a relatively small grid spacing, e.g., ½ inch. If a courser fiber such as Huacaya is being tumbled, panels having a larger grid size can be selected. For this reason, a set of alternative removable panels 107 may be provided, each of which similarly comprise a panel frame 108 and an alternate panel screen grid 111. In other words, the tumbler 100 can be provided with multiple sets of panels, each set having a unique grid size suitable for a range of fibers.

Thus, based on the foregoing discussion, a single fiber tumbler can be adapted to a multiplicity of fibers, eliminating the need for multiple fiber tumblers. This feature is particularly advantageous to a user having a need to tumble a variety of fibers, e.g., a breeder of Suri alpacas and Huacaya alpacas. Because of the cost of a fiber tumbler, breeders oftentimes purchase a fiber tumbler as a group and share the tumbler among the group. The interchangeability of panels is particularly advantageous in this scenario where each breeder may have a different type of fiber. For example, one tumbler may be shared among sheep breeders and alpaca breeders.

In the embodiment shown, each face of the hexagon cage frame 104 except for the end plates 24, 26 is provided with a like removable panel. However, it is to be appreciated that alternate embodiments are envisioned where a portion of the cage frame 104 is covered by a permanently attached screen grid, or solid panel, and only the remaining portion is fitted with removable panels. In such embodiments, the permanently attached screen grid is preferably selected with a grid size at least as small as the smallest panel grid size. Access to the interior of the tumbler cage structure 102 is accomplished by removing one of the removable panels 106,107 as described in more detail below.

The fiber tumbler 100 includes a control panel 120 for controlling operation of the tumbler. The control panel 120 in turn includes a start button 122, a stop button 124, and a direction switch 126. Power is provided to the control panel via a power cord 128, and the control panel controls operation of a power unit 130. The power unit 130 transmits rotational force to the tumbler cage structure 102 by means of a motor pulley (not shown) and a cage pulley 134 which is driven by a drive belt 136 mounted to the pulleys. A tumbler frame 138 supports other elements of the tumbler 100 such as the power unit 130, the control panel 120, and the tumbler cage structure 102. Cage support bearings 142 mounted to the opposite ends of the frame 138 support the cage structure 102 by means of cage bearing shafts 144 mounted at each end of the tumbler cage structure 102.

To facilitate proper tumbling of the fiber, i.e., prevent it from simply rolling at the bottom of the cage structure 102 or from being pinned against the cage by centrifugal forces, the tumbler cage structure should be operated within an appropriate RPM range. Therefore, the combination of the power unit 130, and other elements operatively connecting the power unit 130 to the cage structure 102 for rotational motivation are selected so that the cage structure 102 rotates within the appropriate RPM range. Embodiments of the present application rotate at approximately 30 RPM, although other rotational speeds in the range of 20-40 RPM may be suitable. While the embodiments described herein utilize a belt and pulley arrangement to rotate the cage structure at the desired RPM, it is to be appreciated that any suitable drive mechanism falls within the scope of the present application.

To further facilitate proper tumbling of the fiber, embodiments of the fiber tumbler 100 may include various sets of selectable finger bars 146,148. Each of the finger bars 146, 148 may have different arrangements of fingers 150,152 affixed thereto. While existing fiber tumblers often have fingers permanently mounted to the cage frame 16, embodiments of the present application may have finger bars 146,148 removably mounted to the cage frame 104 so that a user may select an arrangement of fingers 150,152 most suitable for the fiber to be tumbled. The fingers enhance the tumbling operation in at least two ways. First, the fingers aid in lifting the fiber in an upward direction as the cage frame 104 rotates. This helps ensure that the fiber tumbles properly, rather than simply rolling in the bottom of the cage structure 102 as the cage frame 104 rotates. The second enhancement to the tumbling operation arises from the picking and separating effect of the fingers 150,152. As the fingers 150,152 are lifting the fiber, they have the effect of picking, i.e., separating the fiber somewhat which aids in removal of particles from the fiber, which further assists in maintaining the fiber in a fluffed, i.e., non-compacted condition. If the fiber were to simply roll in the bottom of the cage structure 102, it may become more compacted which is undesirable with regards to both cleaning efficacy and subsequent processing of the fiber.

The selected finger bars 146,148 may be removably attached to the cage frame 104 in a desired quantity any suitable means such as, e.g., nuts and bolts, screws, snaps, magnets, etc. One can appreciate that the feature of removably mounted finger bars readily lends itself to experimentation by the user to find the most suitable configuration for various types of fiber. In fact, if the fingers 150,152 are comprised of a suitable wire-like or rod-like material, they can be manually shaped for experimentation. While various materials may be used for the fingers 150,152, the fingers are preferably comprised of a somewhat springy material such as, e.g., music wire of an appropriated diameter. Embodiments described herein utilize a music wire of approximately ⅛ inch diameter and 8 inch length, although any conceivable material, size and shape fall within the scope of the present application.

Because embodiments of the fiber tumbler disclosed herein are adaptable to various fiber types, alternate embodiments may be provided with wheels 170 mounted, e.g., on axles 172, which is beneficial for users sharing one tumbler but using the tumbler at various locations, e.g., at each user's farm. Portability is also a beneficial feature for a user renting their fiber tumbler to others on an hourly, daily or other basis. Further, the alternate embodiments may be provided with the wheels 170 and axles 172 removably mounted to the frame 138 so that a user may easily convert a tumbler to stationary-only use by removing the wheels 170, and optionally removing the axles 172.

In operation, after selecting and installing or removing finger bars 146,148 as previously described, the user selects a set of panels 106,107 including panel screen grid 110,111 of suitable size. The panels are then installed in the cage frame 104 if not already installed. One panel may be omitted to allow an opening for loading the fiber to the interior of the tumbler cage structure 102. After loading the fiber, the user installs the last panel 106 and operates the tumbler for a sufficiently long period of time to clean or otherwise enhance the fiber for subsequent processing of the fiber. Such enhancement includes but is not limited to, e.g., fluffing and loosening of a matted fiber. The embodiment shown is operated via the start and stop switches 122, 124 and the direction switch 126, however, concepts of the present application apply with equal efficacy to any form of rotational motivation such as, e.g., manual operation of a crank mechanism, or to unidirectional rotation. Upon completion of the tumbling process, the user stops rotation of the tumbler cage structure 102 and removes the most conveniently positioned panel 106,107. The ability to remove the most conveniently located panel 106,107 is an additional advantageous feature of embodiments of the present application. Prior art tumblers are normally fitted with only one hinged access panel. For this reason, after the prior art tumbler is stopped, the user must manually rotate the tumbler cage until the hinged panel is accessible. Embodiments of tumblers featuring concepts of the present application may be stopped in any position yet can be conveniently unloaded without further manual rotation. Further, if two users are present, an additional panel horizontally opposite to the first-removed panel may be removed so that both users may simultaneously unload and/or load the tumbler cage from opposite sides.

Figure 3:
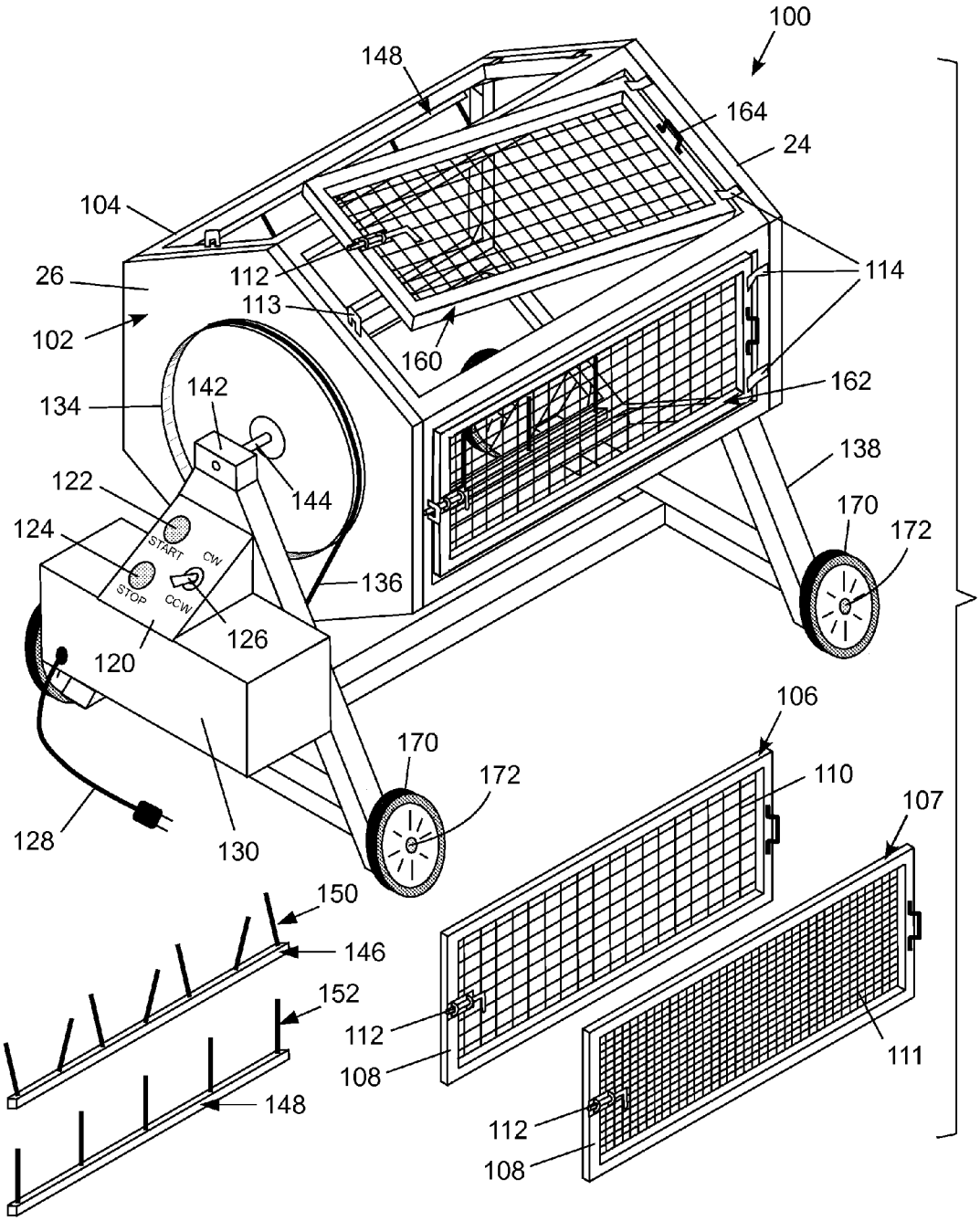
FIG. 3 shows a tumbler cage structure with one panel installed and a second panel being installed.

With reference now to FIG. 3, and continuing reference to FIGS. 1-2, insertion of a panel 160 into the tumbler cage frame 104 according to the embodiment shown is described in more detail. The panel 160 shown in the exemplary FIG. is a panel selected from one of the sets of panels 106,107. As shown in FIG. 3, the panel 160 is held at one end by gripping a handle 164 attached to the panel. The opposite end is held by gripping the latch 112 as the tilted panel is slid under the tabs 114. Braces 166, as shown in FIG. 2, affixed at each corner of the cage frame 104 opening into which the panel is being inserted support the underside of the panel and prevent it from falling though to the cage interior. Once the panel 160 is fully engaged under the tabs 114, the latch is lowered and engaged to a retainer catch 113. A second like panel 162, also selected from one of the sets of panels 106,107, is shown is shown fully installed on the tumbler cage frame 104 with the handle 164 end of the panel 162 engaged under the adjacent tabs 114, supported on the underside by the corner braces 166. It is to be understood that the panel embodiment described with reference to FIGS. 2-3 is an exemplary panel and the present application is not limited to the embodiment shown. Any form of removable panel, or other portion of the tumbler cage is intended to fall within the scope of the present application.

Figure 4:
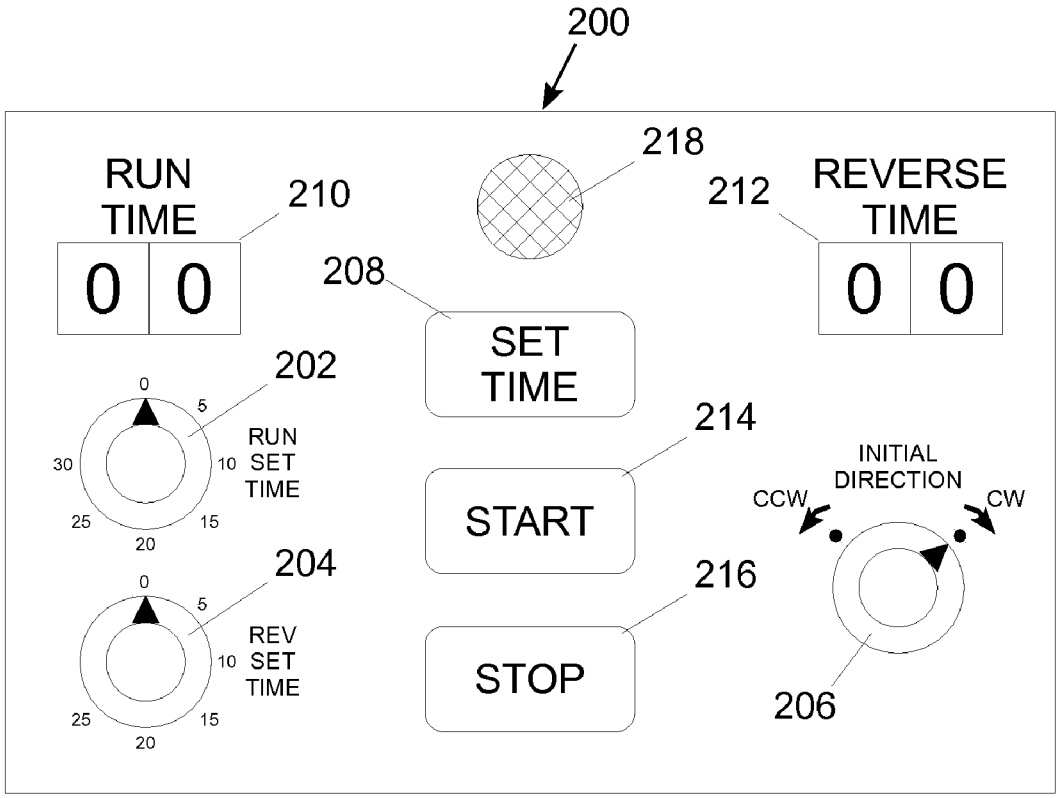
FIG. 4 shows an automatic controller for controlling operation of a power unit of a fiber tumbler.

With reference now to FIG. 4, and continuing reference to FIGS. 2-3, an automatic controller 200 for controlling operation of the power unit 130 of the fiber tumbler 100 is shown. The automatic controller 200 is intended for use with a reversible fiber tumbler, i.e., a tumbler that can rotate in either direction or in alternate directions on a timed basis. Included on the automatic controller are a Run Set Time control 202, a Reverse Set Time control 204, and an Initial Direction control 206. In operation, the user first programs the desired total rotation time, e.g., minutes, with the Run Set Time control 202. Similarly, the amount of time to rotate in the initial direction before reversing is programmed with the Reverse Set Time control 204, and the initial direction of rotation is programmed with the Initial Direction control 206. If the Reverse Set Time control 204 is set at the zero position, the tumbler will not reverse direction and will rotate only in accordance with the Initial Direction control 206. The aforementioned controls may be conveniently left permanently at a desired programmed setting if multiple fiber tumbler loads are to be tumbled with like settings.

After setting the run time, reverse time and initial direction, the user then operates a Set Time control 208. The Set Time control 208 is a momentary action device such as, e.g., a momentary push button contact. When the Set Time control 208 is operated, the run and reverse times previously programmed are respectively displayed in a Run Time display 210 and a Reverse Time display 212. The user activates the Start control 214 which starts rotational operation of the tumbler cage structure 102. Provided no user intervention takes place by activating a Stop control 216, for example, the tumbler 100 operates for the full programmed run time as long as the Run Time display 210 displays a non-zero time. Each of the Run Time display 210 and the Reverse Time display 212 count down on a timely basis while the tumbler 100 is operating, e.g., each minute, thus showing the remaining time at the current state of operation. However, in the event that the Reverse Set Time control 204 is programmed to zero, the Reverse Time display 212 will be inactive or continuously display zero. In the event that the Reverse Set Time control 204 is programmed to a non-zero position, when the Reverse Time display 212 has counted down to zero, the power unit 130 is deactivated for a brief period of time, e.g., 2 seconds, to allow rotation of the tumbler cage structure 102 to come to a complete stop. After the brief deactivation, the power unit 130 is reactivated in the opposite direction, and the Reverse Time display 212 again displays the time programmed with the Reverse Set Time control 204 and again counts down as before.

When the Run Time display 210 has counted down to zero, rotation of the tumbler cage structure 102 is stopped by deactivating the power unit 130. In one embodiment, the Reverse Time display 212 is programmed to reset to zero when the Run Time display counts down to zero in case the run time is not programmed as a multiple of the reverse time. In an alternate embodiment, after the Run Time display 210 has counted down to zero, and rotation of the tumbler cage structure 102 has stopped, the Run Time display 210 and the Reverse Time display 212 are programmed to reset to the times programmed with the Run Set Time control 202 and the Reverse Set Time control 204. In this alternate embodiment, the user may simply activate the Start control 208 after loading the next batch of fiber in the tumbler cage structure 102 and the tumbler will operate identically to the previous tumbling operation.

In some embodiments, the automatic controller includes a warning device 218. The warning devise may be any of an audible tone device, an illuminated display, a voice synthesizer, and a recorded voice playback device, or any combination thereof. In these embodiments, the automatic controller is configured to activate the warning device for a short period of time, e.g., 2 seconds, prior to starting rotation of the fiber cage and whenever the power unit is paused. The automatic controller may also be configured to activate the warning device for a short period of time when the Run Time display has counted down to zero, e.g., 5 seconds, to indicate completion of the tumbling operation.

Figure 5:
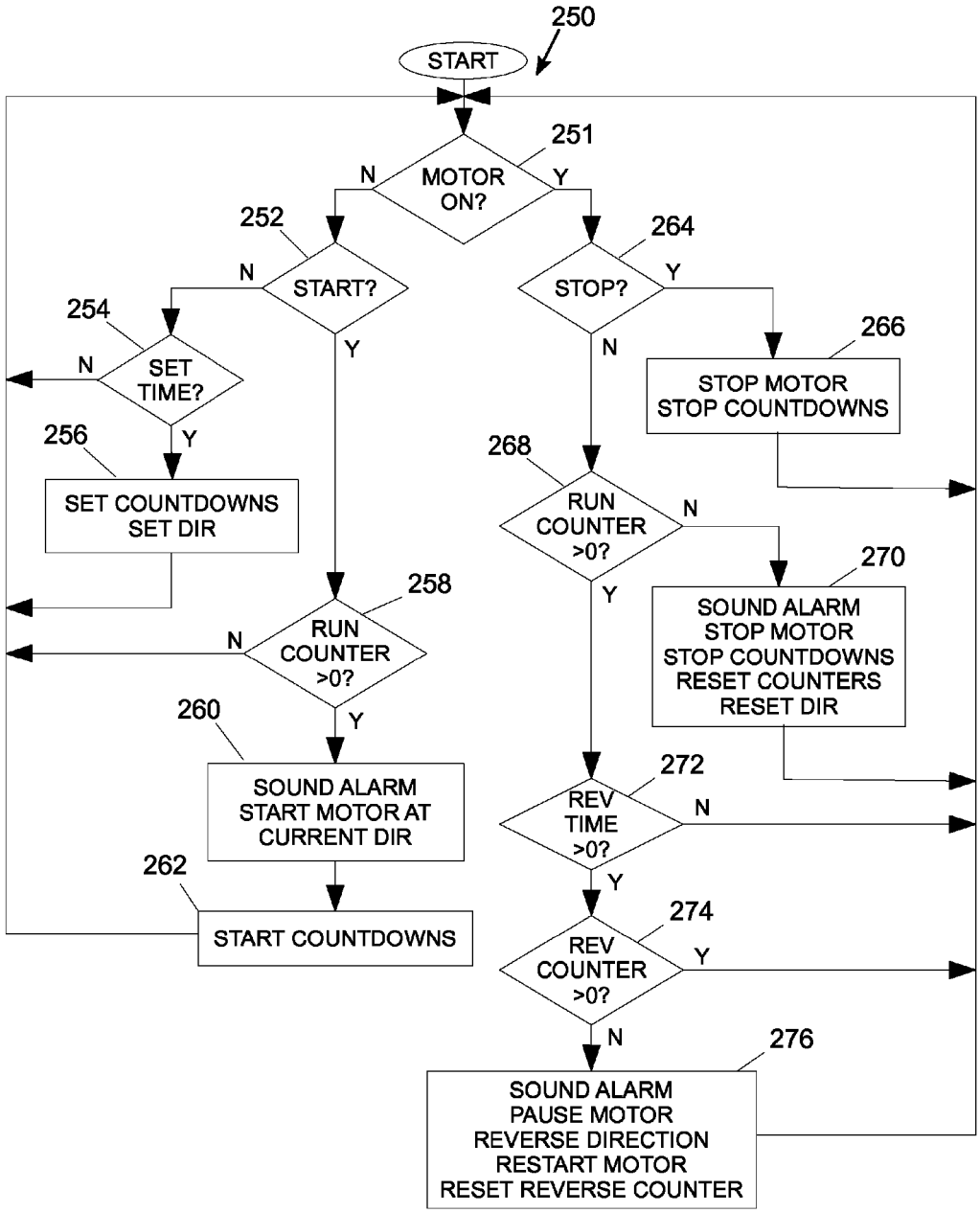
FIG. 5 is a flowchart for implementing logic associated with an automatic fiber tumbler controller.

With reference now to FIG. 5, a flowchart 250 for implementing the logic associated with the previously described automatic controller 200 is shown. It is to be understood, however, that the flowchart is not limiting and is provided only for the purpose of providing a clearer understanding of operation of the automatic controller 200. For example, while steps in the flowchart are presented in a sequential sequence as might be implemented in a computer program, various embodiments may use electronic circuits operating either sequentially or in parallel. At step 251, a determination is made regarding the current state of a motor in the power unit 130. If the motor is not powered, i.e., off, the state of the Start control 214 is determined at step 252. If the Start control is not activated, the Set Time control 208 state is determined. If the Set Time control is not activated, control returns to the top of the loop at step 251. If the Set Time control 208 is activated as determined at step 254, the Run Time display 210 and the Reverse Time display 212 are programmed at step 256 to display the countdown times programmed with the Run Set Time control 202 and the Reverse Set Time control 204. The direction of rotation of the Power Unit 130 is also set at this time according to the Initial Direction control 206.

Returning now to step 252, if the Start Control is not activated, the Rotation Time display is examined at step 258. If the remaining rotation time is not greater than zero, control returns to step 251. Otherwise, at step 260, the motor of the power unit 130 is started in the currently programmed direction of rotation. In some embodiments, however, the alarm 218 is activated for a brief period of time, e.g., 2 seconds, prior to starting the power unit 130. The Rotation Time display 210 and the Reverse Time display 212 are programmed to countdown, preferably in minutes, at this time at step 262. However, neither display will continue counting down once zero is displayed. Control now returns to step 251.

Returning now to step 251, if the motor of power unit 130 is determined to be running, i.e., in a powered state, the state of the Stop control 216 is determined at step 264. If the Stop control is activated, the motor is stopped at step 266 and the Run Time display 210 and the Reverse Time display 212 are frozen at their current state, i.e., the time countdown stops, and control returns to step 251. If, however, the Stop control 216 is not activated, the state of the Run Time display 210 is determined at step 268 and, if zero, operation of the tumbler 100 is stopped at step 270. The motor of Power Unit 130 is stopped, the Run Time display and the Reverse Time display 212 is set to zero, or alternately set to the times programmed programmed on the Run Set Time control 202 and the Reverse Set Time control 204. In either case, however, the countdown process is suspended. The motor is configured to run in the direction programmed on the Initial Direction control 206 on its next activation. Additionally, in some embodiments, the alarm 218 is activated for a short period of time, e.g., 5 seconds to alert the user that the programmed tumbling operation has completed.

Returning now to step 268, if the Run Time display is greater than zero, the time programmed with the Reverse Set Time control 204 is determined at step 272. If the reverse time is programmed to zero, i.e., no reversing, control simply returns to step 251. Otherwise, the state of the Reverse Time display 212 is determined at step 274. If the Reverse Time display is non-zero, control again returns to step 251. Otherwise, at step 276, the motor of power unit 130 is paused momentarily, e.g., for 2 seconds, to allow rotation of the tumbler cage structure 102 to stop completely. In some embodiments, the alarm 218 is activated during the momentary pause. The direction controls for the motor are reversed and the motor is restarted. The Reverse Time display is reset to display the time programmed on the Reverse Set Time control 204, and control returns to step 251.

Figure 6:
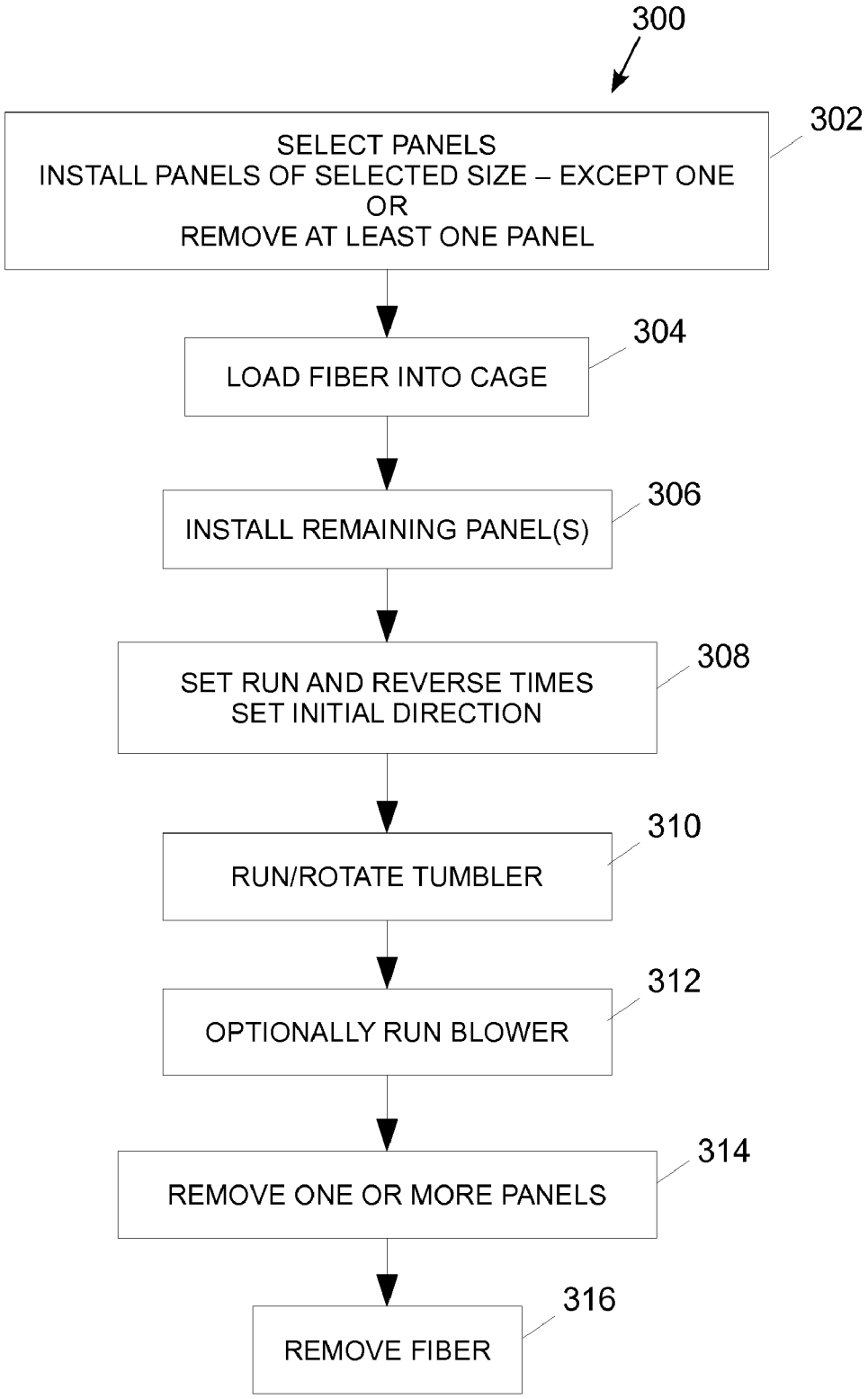
FIG. 6 is a method of tumbling fiber using selected panels having grid sizes suitable for the fiber being tumbled.

With reference now to FIG. 6, a method 300 of tumbling fiber using the fiber tumbler 100 of the foregoing figures is shown. As shown, in operation 302, the user determines a correct screen grid size for the fiber to be tumbled and selects a set of panels accordingly. The selected set of panels 106,107 is installed if not already installed. However, at least one panel is not installed, allowing providing an opening for admission of the fiber into the tumbler cage structure 102. Thereafter, in operation 304, the fiber is inserted into the tumbler cage structure 102 through the opening where the at least one panel has not been installed (or has been removed if necessary). Next, in operation 306, The remaining panels 106,107 are installed on the tumbler cage structure 102. In operation 308, the tumbler rotation time, reverse cycle time (if any), and the direction of rotation (if programmable) are programmed on the control panel of the tumbler 100. The tumbler cage structure 102 is subsequently rotated in operation 310 about a horizontal axis according to the programmed times and direction. To enhance particle removal from the fiber, the user may place a blower near the rotating cage structure 102 to blow the fiber in operation 312. Once the particles are sufficiently removed, and/or the programmed rotation time has expired, at least one of the panels 106 is removed from the tumbler cage structure 102 to gain access to the interior of the cage in operation 314. The fiber is removed from the tumbler cage structure 102 in operation 316. It is to be understood that, while the method described above is described with steps in a given order, the method is not limited in this regard, and at least some of the operations may be performed in an alternate order, or even omitted entirely. For example, in the case of a manually operated tumbler, operation 308 may be omitted.

The exemplary embodiments have been described with reference to the specific embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A fiber tumbler for tumbling a plurality of fiber types, the fiber tumbler comprising:

a tumbler frame;

a fiber cage structure, the fiber cage structure including:

a cage frame pivotally coupled to the tumbler frame for rotation of the fiber cage structure about a rotational axis;

at least one removable first cage panel, wherein the first cage panel covers an exterior portion of the cage frame when installed on the cage frame, the removable first cage panel including a plurality of first openings sized large enough to permit particles to exit the fiber cage structure while yet sized small enough to substantially retain a first type of fiber within the fiber cage structure; and at least one removable second cage panel, wherein the second cage panel covers the exterior portion of the cage frame when installed on the cage frame, the removable second cage panel including a plurality of second openings sized large enough to permit particles to exit the fiber cage structure while yet sized small enough to substantially retain a second type of fiber within the fiber cage structure, wherein a user selects at least one cage panel from the at least one removable first cage panel and the at least one removable second cage panel suitable for use on the cage frame when tumbling a selected fiber, wherein the user inserts and removes the selected fiber into and from the fiber cage structure by removing at least one selected cage panel and reinstalling the removed at least one selected cage panel prior to rotating the fiber cage structure, wherein the selected fiber tumbles within the fiber cage structure upon rotation of the fiber cage structure, and wherein particles are removed from the selected fiber upon rotation of the fiber cage structure;

a power unit for rotating the fiber cage structure, wherein the cage frame comprises one of: a round cylinder; an octagonal cylinder; a hexagonal cylinder; and a square cylinder, wherein each face defined by the cage frame parallel to the rotational axis of the one of the octagonal cylinder; the hexagonal cylinder; and the square cylinder is adapted to receive the selected cage panel, wherein each end of the round cylinder comprises a circular end frame, and the end frames are connected to each other by at least two cage frame members parallel to the rotational axis, the cage frame members defining surface segments of the round cylinder such that each surface segment is adapted to receive the selected cage panel, and wherein the fiber cage structure rotates when the power unit is turned on by the user and stops when the power unit is turned off by the user; and an automatic controller for controlling operation of the power unit, the automatic controller comprising:

a Run Set Time control whereby the user programs a run time corresponding to a desired total rotation time of the fiber cage structure;

a Reverse Set Time control whereby the user programs a reverse time corresponding to an amount of time to rotate in a first direction before reversing and rotating in a second direction;

an Initial Direction control whereby the user programs a direction of rotation corresponding to the first direction, wherein the fiber cage structure will not reverse direction of rotation and will rotate only in accordance with the Initial Direction control if the Reverse Set Time control is programmed to a zero setting;

a Run Time display;

a Reverse Time display;

a Set Time control, wherein the programmed run time and the programmed reverse time are respectively displayed in the Run Time display and the Reverse Time display when the Set Time control is activated momentarily;

a Start control for starting rotation of the fiber cage structure;

a Stop control for stopping rotation of the fiber cage structure;

wherein each of the Run Time display and the Reverse Time display count down on a timely basis while the fiber cage structure is rotating, the Run Time display showing a remaining total rotation time, and the Reverse Time display showing a remaining rotation time for the current direction of rotation;

wherein, if the Reverse Set Time control is programmed to a zero setting, the fiber cage structure rotates only in the direction programmed with the Initial Direction control;

wherein, if the Reverse Set Time control is programmed to a non-zero setting, when the Reverse Time display has counted down to zero, the power unit paused by deactivating for a period of time sufficient to allow rotation of the fiber cage structure to stop, after which the power unit is reactivated in the opposite direction and the Reverse Time display redisplays the time programmed with the Reverse Set Time control; and wherein, when the Run Time display has counted down to zero, rotation of the fiber cage structure is stopped by deactivating the power unit.

2. The fiber tumbler as set forth in claim 1, wherein, after the Run Time display has counted down to zero and rotation of the fiber cage structure has stopped for a first tumbling operation, the Run Time display and the Reverse Time display automatically redisplay the times programmed with the Run Set Time control and the Reverse Set Time control so that the user may activate the Start control after loading a subsequent batch of fiber in the fiber causing the fiber tumbler to operate identically to the first tumbling operation.

3. The fiber tumbler as set forth in claim 1, wherein the Run Time display and the Reverse Time display are configured to display minutes.

4. The fiber tumbler as set forth in claim 1, further comprising a warning device;

wherein the warning devise comprises at least one of an audible tone device, an illuminated display, a voice synthesizer, and a recorded voice playback device; and wherein the automatic controller is configured to activate the warning device for a first short period of time prior to starting rotation of the fiber cage structure and when the power unit is paused.

5. The fiber tumbler as set forth in claim 4, wherein the automatic controller is configured to activate the warning device for a second short period of time when the Run Time display has counted down to zero.

6. The fiber tumbler as set forth in claim 5, wherein the first short period of time and the second short period of time are at least 2 seconds and not more than 5 seconds.

7. A method of cleaning fiber in a fiber tumbler, comprising:

selecting a set of panels having a grid size suitable for a fiber to be tumbled;

installing the selected set of panels on a fiber cage frame which is pivotally coupled to a tumbler frame for rotation of the fiber cage frame about a rotational axis, leaving at least one panel not installed;

inserting the fiber into a space within the fiber cage frame through an opening in the fiber cage frame made available by the not installed panel;

installing the at least one not installed panel on the fiber cage frame;

rotating the fiber cage frame, wherein the fiber thereby tumbles within the fiber cage frame, causing particles to fall from the tumbler cage frame through the panel grid during rotation of the fiber cage frame;

removing at least one installed panel from the fiber cage frame;

removing the fiber from the fiber cage frame through the opening in the fiber cage frame made available by removing the at least one installed panel; and programming an automatic controller for automatic rotation of the fiber cage frame, wherein the programming includes:

programming a total rotation time;

programming an initial direction of rotation of the fiber cage frame; and programming a reversal time such that the direction of rotation of the fiber cage frame reverses periodically at the programmed reversal time.

8. The fiber tumbler as set forth in claim 1, further comprising:

a plurality of first finger bars;

wherein each of the plurality of first finger bars is configured to be removably mounted on the cage frame;

wherein each of the plurality of first finger bars includes a plurality of first fingers mounted to the first finger bar; and wherein each of the first fingers comprises a rod configured to lift and pick the fiber during rotation of the fiber cage structure when the finger bar is mounted on the cage frame.

9. The fiber tumbler as set forth in claim 8, further comprising:

a plurality of second finger bars;

wherein each of the plurality of second finger bars is configured to be removably mounted on the cage frame;

wherein each of the plurality of second finger bars includes a plurality of second fingers mounted to the second finger bar;

wherein each of the second fingers comprises a rod configured to lift and pick the fiber during rotation of the fiber cage structure when the finger bar is mounted on the cage frame; and wherein the plurality of second fingers is configured differently than the plurality of first fingers.

10. An apparatus for tumbling fiber, the apparatus comprising:

a tumbler frame;

a fiber cage structure pivotally coupled to the tumbler frame for rotation of the fiber cage structure about an axis;

at least one access panel for providing an opening for insertion of the fiber into the fiber cage structure and removal of the fiber from the fiber cage structure, wherein the fiber tumbles within the fiber cage structure upon rotation of the fiber cage structure. and wherein particles are removed from the fiber upon rotation of the fiber cage structure; and an automatic controller for controlling operation of the power unit, the automatic controller comprising:

a Run Set Time control whereby the user programs a run time corresponding to a desired total rotation time of the fiber cage structure;

a Reverse Set Time control whereby the user programs a reverse time corresponding to an amount of time to rotate in a first direction before reversing and rotating in a second direction;

a Start control for starting rotation of the fiber cage structure; and a Stop control for stopping rotation of the fiber cage structure, further comprising:

an Initial Direction control whereby the user programs a direction of rotation corresponding to the first direction, wherein the fiber cage structure will not reverse direction of rotation and will rotate only in accordance with the Initial Direction control if the Reverse Set Time control is programmed to a zero setting;

a Run Time display;

a Reverse Time display;

a Set Time control, wherein the programmed run time and the programmed reverse time are respectively displayed in the Run Time display and the Reverse Time display when the Set Time control is activated momentarily;

wherein each of the Run Time display and the Reverse Time display count down on a timely basis while the fiber cage structure is rotating, the Run Time display showing a remaining total rotation time, and the Reverse Time display showing a remaining rotation time for the current direction of rotation;

wherein, if the Reverse Set Time control is programmed to a zero setting, the fiber cage structure rotates only in the direction programmed with the Initial Direction control;

wherein, if the Reverse Set Time control is programmed to a non-zero setting, when the Reverse Time display has counted down to zero, the power unit paused by deactivating for a period of time sufficient to allow rotation of the fiber cage structure to stop, after which the power unit is reactivated in the opposite direction and the Reverse Time display redisplays the time programmed with the Reverse Set Time control; and wherein, when the Run Time display has counted down to zero, rotation of the fiber cage structure is stopped by deactivating the power unit.

11. The apparatus as set forth in claim 10, wherein the access panel comprises at least one of a hinged access panel and a removable first cage panel.

12. The apparatus as set forth in claim 11, further comprising at least one removable second cage panel having first openings;

wherein the removable second cage panel includes a plurality of second openings sized differently than the first openings such that the first cage panel is suitable for tumbling a first type of fiber, and the second cage panel is suitable for tumbling a second type of fiber.

13. The apparatus as set forth in claim 12, wherein:

the first cage panel comprises a first wire grid defining a plurality of first openings; and the second cage panel comprises a second wire grid defining a plurality of second openings.

14. The apparatus as set forth in claim 13, further comprising:

at least one removably mounted finger bar including a plurality of fingers mounted to the finger bar, wherein the fingers are configured to lift and pick the fiber during rotation of the fiber cage structure.

15. The apparatus as set forth in claim 13, wherein:

the first cage panel further comprises a first panel frame supporting the first wire grid; and the second cage panel further comprises a second panel frame supporting the second wire grid.

16. The apparatus as set forth in claim 15, wherein:

the first cage panel comprises a first wire grid defining a plurality of first square openings approximately ½ inch square; and the second cage panel comprises a second wire grid defining a plurality of second square openings approximately 1 inch square.

* * * * *